US007661487B2

(12) United States Patent
Hall et al.

(10) Patent No.: US 7,661,487 B2
(45) Date of Patent: Feb. 16, 2010

(54) DOWNHOLE PERCUSSIVE TOOL WITH ALTERNATING PRESSURE DIFFERENTIALS

(76) Inventors: David R. Hall, 2185 S. Larsen Pkwy., Provo, UT (US) 84606; Scott Dahlgren, 2185 S. Larsen Pkwy., Provo, UT (US) 85606; Jonathan Marshall, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/415,315
(22) Filed: Mar. 31, 2009

(65) Prior Publication Data

US 2009/0183920 A1 Jul. 23, 2009

Related U.S. Application Data

(63) Continuation of application No. 12/415,188, filed on Mar. 31, 2009, which is a continuation-in-part of application No. 12/178,467, filed on Jul. 23, 2008, which is a continuation-in-part of application No. 12/039,608, filed on Feb. 28, 2008, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, said application No. 12/178,467 is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, which is a continuation-in-part of application No. 11/306,976, filed on Jan. 18, 2006, which is a continuation-in-part of application No. 11/306,307, filed on Dec. 22, 2005, which is a continuation-in-part of application No. 11/306,022, filed on Dec. 14, 2005, which is a continuation-in-part of application No. 11/164,391, filed on Nov. 21, 2005, said application No. 12/178,467 is a continuation-in-part of application No. 11/555,334, filed on Nov. 1, 2006, now Pat. No. 7,419,018.

(51) Int. Cl.
*E21B 4/14* (2006.01)

(52) U.S. Cl. ..... 175/57; 175/296; 175/389; 175/415

(58) Field of Classification Search ..... 175/57, 175/296, 321, 389, 414, 415; 173/200, 201, 173/206, 207
See application file for complete search history.

(56) References Cited

U.S. PATENT DOCUMENTS 465,103 A 12/1891 Wegner (Continued)

*Primary Examiner*—Hoang Dang
(74) *Attorney, Agent, or Firm*—Philip W. Townsend, III; Tyson J. Wilde

(57) ABSTRACT

A downhole percussive tool is disclosed comprising an interior chamber and a piston element slidably sitting within the interior chamber forming two pressure chambers on either side. The piston element may slide back and forth within the interior chamber as drilling fluid is channeled into either pressure chamber. Input channels supply drilling fluid into the pressure chambers and exit orifices release that fluid from the same. An exhaust orifice allows additional drilling fluid to release from the interior chamber. The amount of pressure maintained in either pressure chamber may be controlled by the size of the exiting orifices and exhaust orifices. In various embodiments, the percussive tool may form a downhole jack hammer or vibrator tool.

19 Claims, 9 Drawing Sheets

U.S. PATENT DOCUMENTS 616,118 A 12/1898 Kunhe
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midgett
1,460,671 A 7/1923 Habsacker
1,544,757 A 7/1925 Hufford
1,621,474 A 9/1931 Mercer
1,879,177 A 9/1932 Gault
2,054,255 A * 9/1936 Howard ..... 175/298
2,064,255 A 12/1936 Garfield
2,169,223 A 8/1939 Christian
2,216,130 A 10/1940 Court
2,320,136 A 5/1943 Kammerer
2,466,991 A 4/1949 Kammerer
2,540,464 A 2/1951 Stokes
2,544,336 A 3/1951 Kammerer
2,755,071 A 7/1956 Kammerer
2,776,819 A 1/1957 Brown
2,819,043 A 1/1958 Henderson
2,838,284 A 6/1958 Austin
2,868,511 A * 1/1959 Barrett ..... 175/92
2,873,093 A * 2/1959 Hildebrandt et al. ..... 175/92
2,894,722 A 7/1959 Buttolph
2,901,223 A 8/1959 Scott
2,942,851 A * 6/1960 Beck ..... 175/107
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schofield
3,583,504 A 6/1971 Aalund
3,764,493 A 10/1973 Roser
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,161,631 A * 12/2000 Kennedy et al. ..... 175/171
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,502,650 B1 * 1/2003 Beccu ..... 175/296
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,698,537 B2 * 3/2004 Pascale et al. ..... 175/300
6,729,420 B2 5/2004 Mensa-Wilmot
6,732,817 B2 5/2004 Dewey
6,822,579 B2 11/2004 Goswani
6,929,076 B2 8/2005 Fanuel et al.
6,953,096 B2 10/2005 Gledhill
7,096,980 B2 * 8/2006 Trevas ..... 175/296
7,240,744 B1 * 7/2007 Kemick ..... 175/106
2003/0213621 A1 11/2003 Britten
2004/0238221 A1 12/2004 Runia
2004/0256155 A1 12/2004 Kriesels

* cited by examiner

DOWNHOLE PERCUSSIVE TOOL WITH ALTERNATING PRESSURE DIFFERENTIALS

CROSS REFERENCE TO RELATED APPLICATIONS

This patent application is a continuation of U.S. patent application Ser. No. 12/415,188 filed Mar. 31, 2009 which is a continuation-in-part of U.S. patent application Ser. No. 12/178,467 filed Jul. 23, 2008 which is a continuation-in-part of U.S. patent application Ser. No. 12/039,608 filed Feb. 28, 2008 which is a continuation-in-part of U.S. patent application Ser. No. 12/037,682 filed Feb. 26, 2008 now U.S. Pat. No. 7,624,824 which is a continuation-in-part of U.S. patent application Ser. No. 12/019,782 filed Jan. 25, 2008 now U.S. Pat. No. 7,617,886 which is a continuation-in-part of U.S. patent application Ser. No. 11/837,321 filed Aug. 10, 2007 now U.S. Pat. No. 7,559,379 which is a continuation-in-part of U.S. patent application Ser. No. 11/750,700 filed May 18, 2007 now U.S. Pat. No. 7,549,489 which is a continuation-in-part of U.S. patent application Ser. No. 11/737,034 filed Apr. 18, 2007 now U.S. Pat. No. 7,503,405 which is a continuation-in-part of U.S. patent application Ser. No. 11/686,638 filed Mar. 15, 2007 now U.S. Pat. No. 7,424,922 which is a continuation-in-part of U.S. patent application Ser. No. 11/680,997 filed Mar. 1, 2007 now U.S. Pat. No. 7,419,016 which is a continuation-in-part of U.S. patent application Ser. No. 11/673,872 filed Feb. 12, 2007 now U.S. Pat. No. 7,484,576 which is a continuation-in-part of U.S. patent application Ser. No. 11/611,310 filed Dec. 15, 2006 now U.S. Pat. No. 7,600,586.

U.S. patent application Ser. No. 12/178,467 is also a continuation-in-part of U.S. patent application Ser. No. 11/278,935 filed Apr. 6, 2006 now U.S. Pat. No. 7,426,968 which is a continuation-in-part of U.S. patent application Ser. No. 11/277,394 filed Mar. 24, 2006 U.S. Pat. No. 7,398,837 now which is a continuation-in-part of U.S. patent application Ser. No. 11/277,380 filed Mar. 24, 2006 which is a continuation-in-part of U.S. patent application Ser. No. 11/306,976 filed Jan. 18, 2006 which is a continuation-in-part of U.S. patent application Ser. No. 11/306,307 filed Dec. 22, 2005 which is a continuation-in-part of U.S. patent application Ser. No. 11/306,022 filed Dec. 14, 2005 which is a continuation-in-part of U.S. patent application Ser. No. 11/164,391 filed Nov. 21, 2005.

U.S. patent application Ser. No. 12/178,467 is also a continuation-in-part of U.S. patent application Ser. No. 11/555,334 filed Nov. 1, 2006 now U.S. Pat. No. 7,419,018.

All of these applications are herein incorporated by reference in their entirety.

BACKGROUND OF THE INVENTION

The present invention relates to the field of downhole oil, gas and/or geothermal exploration and more particularly to the field of percussive tools used in drilling. More specifically, the invention relates to the field of downhole jack hammers and vibrators which may be actuated by the drilling fluid or mud.

Percussive jack hammers are known in the art and may be placed at the end of a bottom hole assembly (BHA). There they act to more effectively apply drilling power to the formation, thus aiding penetration into the formation.

U.S. Pat. No. 7,424,922 to Hall, et al., which is herein incorporated by reference for all that it contains, discloses a jack element which is housed within a bore of a tool string and has a distal end extending beyond a working face of the tool string. A rotary valve is disposed within the bore of the tool string. The rotary valve has a first disc attached to a driving mechanism and a second disc axially aligned with and contacting the first disc along a flat surface. As the discs rotate relative to one another at least one port formed in the first disc aligns with another port in the second disc. Fluid passed through the ports is adapted to displace an element in mechanical communication with the jack element.

Percussive vibrators are also known in the art and may be placed anywhere along the length of the drill string. Such vibrators act to shake the drill string loose when it becomes stuck against the earthen formation or to help the drill string move along when it is laying substantially on its side in a nonvertical formation. Vibrators may also be used to compact a gravel packing or cement lining by vibration, or to fish a stuck drill string or other tubulars, such as production liners or casing strings, gravel pack screens, etc., from a bore hole.

U.S. Pat. No. 4,890,682 to Worrall, et al., which is herein incorporated by reference for all that it contains, discloses a jarring apparatus provided for vibrating a pipe string in a borehole. The apparatus thereto generates at a downhole location longitudinal vibrations in the pipe string in response to flow of fluid through the interior of said string.

U.S. Pat. No. 7,419,018 to Hall, et al., which is herein incorporated by reference for all that it contains, discloses a downhole drill string component which has a shaft being axially fixed at a first location to an inner surface of an opening in a tubular body. A mechanism is axially fixed to the inner surface of the opening at a second location and is in mechanical communication with the shaft. The mechanism is adapted to elastically change a length of the shaft and is in communication with a power source. When the mechanism is energized, the length is elastically changed.

Not withstanding the preceding patents regarding downhole jack hammers and vibrators, there remains a need in the art for more powerful mud actuated downhole tools. There is also a need in the art for means to easily adjust the force of the downhole tool. Thus, further advancements in the art are needed.

BRIEF SUMMARY OF THE INVENTION

In one aspect of the present invention a downhole tool string comprises a downhole percussive tool. The percussive tool comprises an interior chamber with a piston element that divides the interior chamber into two pressure chambers. The piston element may slide back and forth within the interior chamber thus altering the volumes of the two pressure chambers. The percussive tool also comprises input channels that may lead drilling fluid into the interior chamber or bypass the interior chamber and continue along the drill string. The percussive tool additionally comprises exit orifices that may release drilling fluid from the interior chamber or may take drilling fluid directly from the input channels and send it along the drill string. Furthermore, the percussive tool comprises exhaust orifices that may release drilling fluid from the interior chamber.

The present invention may comprise a rotary valve that is actively driven. The driving mechanism may be a turbine, a motor, or another suitable means known in the art. The rotary valve comprises two discs that face each other along a surface. Both discs have ports formed therein that may align or misalign as the discs rotate relative to one another. The discs may comprise materials selected from the group consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

In a first stroke of the piston element, the two discs rotate relative to one another and the ports misalign to block the flow of drilling fluid to a first group of input channels. At the same moment, the ports align to allow a second group of input channels to feed drilling fluid into a first pressure chamber on one side of the interior chamber and also out through exit orifices. The flow of drilling fluid into the first pressure chamber causes the pressure to rise in that chamber and forces the piston element to move towards a second pressure chamber. Drilling fluid that may be in the second pressure chamber is forced out through exit orifices or through exhaust orifices. The combined area of the exit orifices and exhaust orifices through which the drilling fluid in the second pressure chamber is being released may be larger than the combined area of the exit orifices through which the drilling fluid from the second group of input channels is flowing, thus causing the pressure to be greater in the first pressure chamber than in the second pressure chamber.

In a second stroke of the piston element, the two discs rotate further relative to one another, thus aligning other ports and allowing the first group of input channels to supply drilling fluid into the second pressure chamber and also out through exit orifices. The ports also misalign to block the flow of drilling fluid to the second group of input channels. The increased pressure from the drilling mud in the second pressure chamber forces the piston element to move back toward the first pressure chamber. The drilling fluid in the first pressure chamber under lower pressure is forced out of exit orifices or through exhaust orifices. The combined area of the exit orifices and exhaust orifices through which the drilling fluid in the first pressure chamber is being released may be larger than the combined area of the exit orifices through which the drilling fluid from the first group of input channels is flowing, thus causing the pressure to be greater in the second pressure chamber than in the first pressure chamber.

Since the pressure differential between the first pressure chamber and the second pressure chamber is a function primarily of the difference in areas of the exit orifices and exhaust orifices dedicated to each, then that pressure differential may be easily adjusted by regulating the size of the orifices used rather than changing the internal geometry of the rotary valve.

In one embodiment of the present invention, the percussive tool acts as a jack hammer. In this embodiment, the percussive tool comprises a jack element that is partially housed within a bore of the drill string and has a distal end extending beyond the working face of the tool string. The back-and-forth motion of the piston element causes the jack element to apply cyclical force to the earthen formation surrounding the drill string at the working face of the tool string. This generally aids the drill string in penetrating through the formation. In this embodiment, the exit orifices and exhaust orifices are formed as nozzles that spray drilling fluid out of the working face of the tool string and also generally allow the drill string to move faster through the formation.

In another embodiment of the present invention, the percussive tool acts as a vibrator. In this embodiment, the percussive tool may be located at any location along the drill string and shakes the drill string as the piston element moves back and forth. The piston element may be weighted sufficiently to shake the drill string or an additional weight may be partially housed within the drill string that acts to shake the drill string.

DETAILED DESCRIPTION OF THE INVENTION AND THE PREFERRED EMBODIMENT

Figure 1:
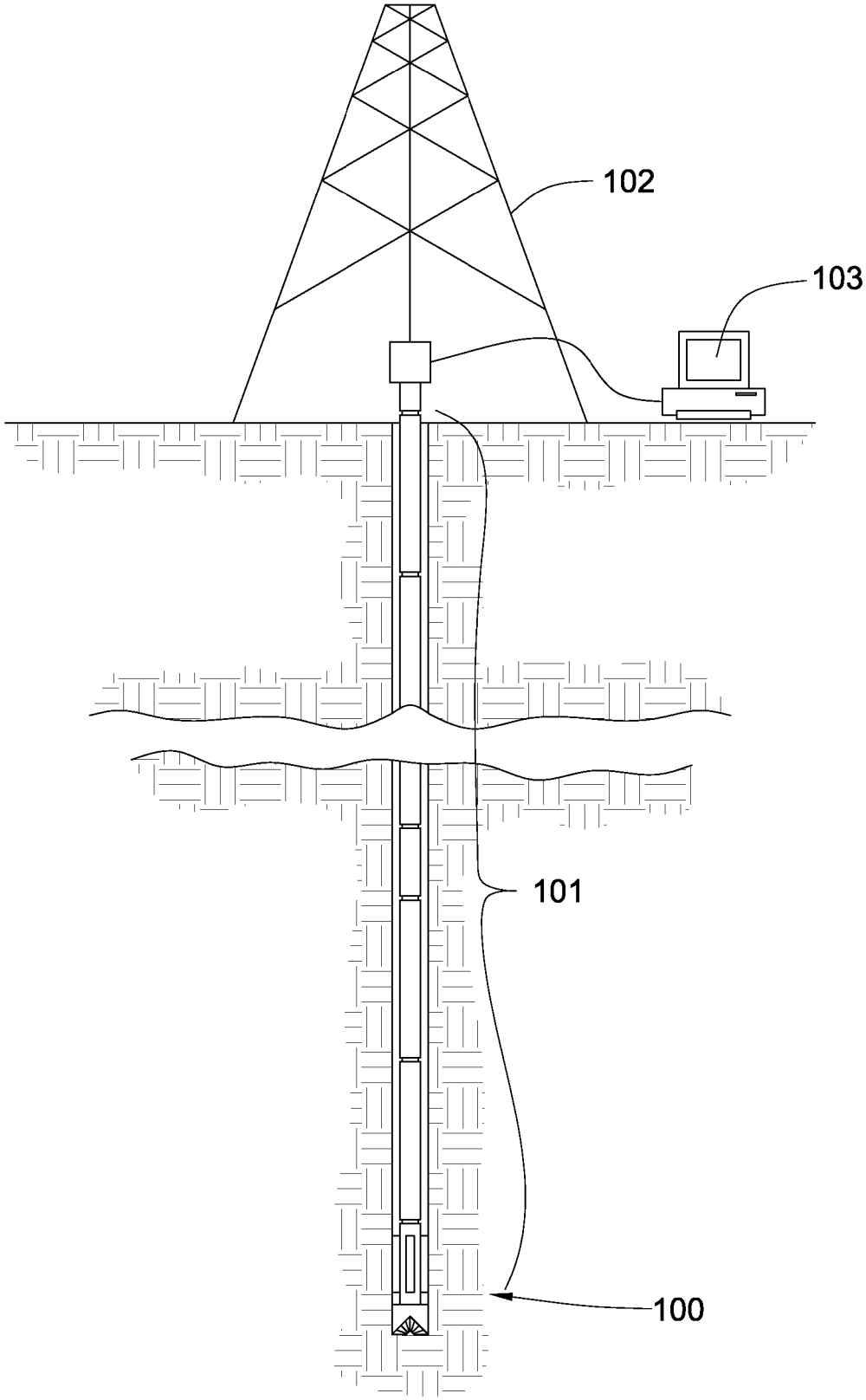
FIG. 1 is a side-view diagram of an embodiment of a downhole tool string assembly.

Referring now to FIG. 1, a downhole drill string 101 may be suspended by a derrick 102. The drill string may comprise one or more downhole drill string tools 100, linked together in a drill string 101 and in communication with surface equipment 103 through a downhole network.

Figure 2:
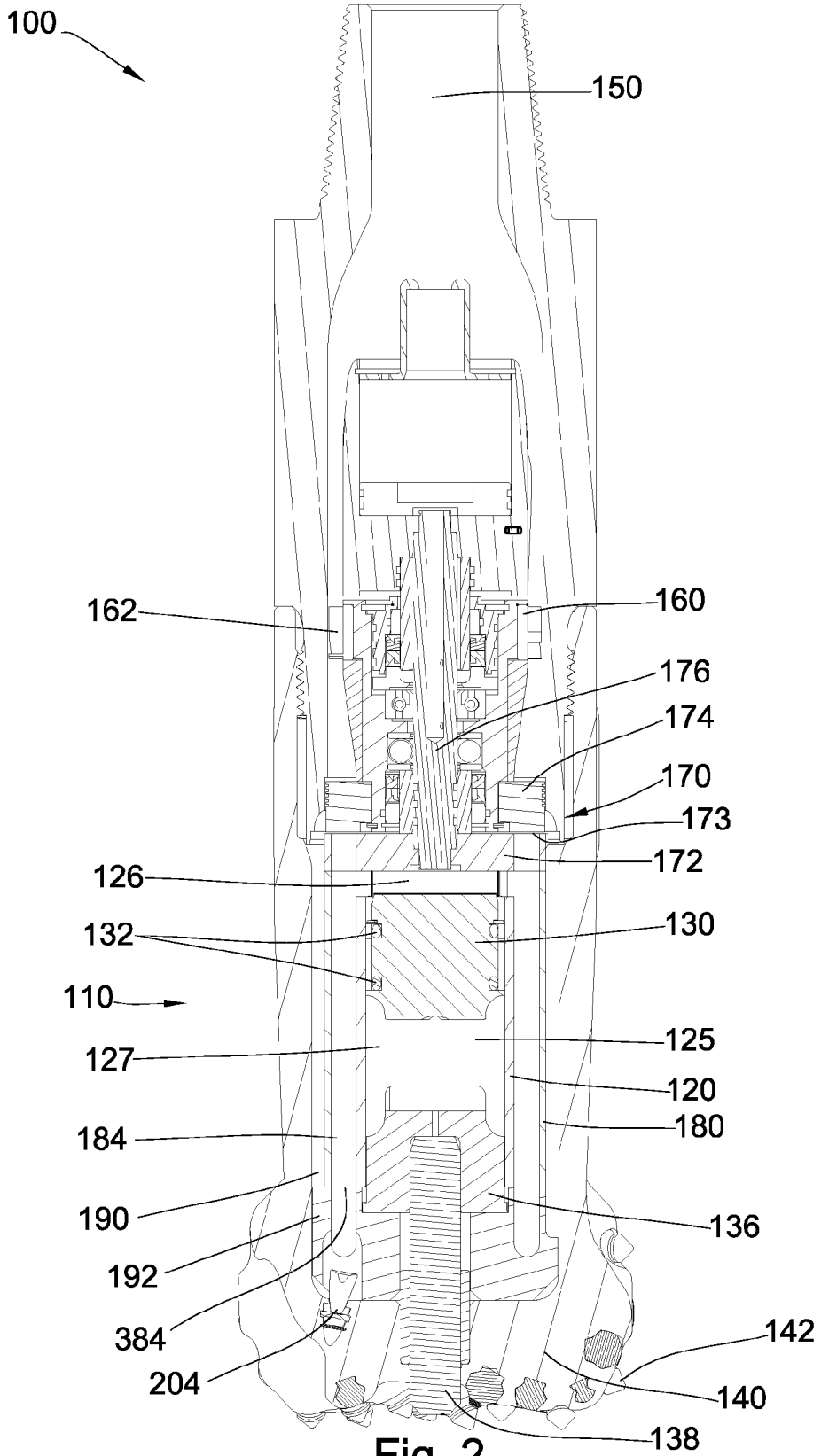
FIG. 2 is a cross-sectional diagram of an embodiment of a downhole percussive tool.

FIG. 2 shows a cross-sectional diagram of an embodiment of a downhole drill string tool 100. This embodiment of a downhole drill string tool 100 comprises a percussive tool 110. The percussive tool 110 comprises an inner cylinder 120 that defines an interior chamber 125. The percussive tool 110 also comprises an outer cylinder 180 which may have multiple internal flutes 182 (see FIG. 3*a*). The outer cylinder 180 substantially surrounds the internal cylinder 120 and the internal flutes 182 may be in contact with the internal cylinder 120 thus forming multiple input channels 184 and 186. (See FIG. 3*a*)

A piston element 130 sits within the interior chamber 125 and divides the interior chamber 125 into a first pressure chamber 126 and a second pressure chamber 127. The piston element 130 may slide back and forth within the interior chamber 125 thus altering the respective volumes of the first and second pressure chambers 126 and 127. The volume of the first pressure chamber 126 may be inversely proportional to the volume of the second pressure chamber 127. The piston element 130 has seals 132 which may prevent drilling fluid from passing between the first pressure chamber 126 and the second pressure chamber 127.

The drill string 101 has a center bore 150 through which drilling fluid may flow downhole. At the percussive tool 110, that center bore 150 may be separated thus allowing the drilling fluid to flow past a turbine 160 which has multiple turbine blades 162. In this embodiment, the turbine 160 acts as a driving mechanism to drive a rotary valve 170. In other embodiments, the driving mechanism may be a motor or another suitable means known in the art.

The rotary valve 170 comprises a first disc 174 which is attached to the driving mechanism, the turbine 160 in this embodiment, and a second disc 172 which is axially aligned with the first disc 174 by means of an axial shaft 176. The second disc 172 also faces the first disc 174 along a surface 173. The first disc 174 and the second disc 172 may comprise materials selected from the group consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof. A superhard material such as diamond or cubic boron nitride may line internal edges 371 of the first disc 174 and second disc 172 to increase resistance to erosion. The superhard material may be sintered, inserted, coated, or vapor deposited.

The first disc 174 may comprise through ports 370 and exhaust ports 372. (See FIG. 3*f*) The second disc 172 may comprise first ports 374 and second ports 376. (See FIG. 3*e*) As drilling fluid flows down the center bore 150 and passes by the turbine blades 162 it causes the turbine 160 to rotate. This rotation causes the first disc 174 and the second disc 172 to rotate relative to one another.

In a first stroke of the piston element 130, as the first and second discs 174 and 172 rotate relative to one another, the through ports 370 of the first disc 174 align with the second ports 376 of the second disc 172. This allows drilling fluid to flow into the second input channels 186. From here the fluid can flow into the first pressure chamber 126 or flow down the second input channels 186 and out a second exit orifice 386. (See FIGS. 3*g* and 3*h*) Also during the first stroke the exhaust ports 372 of the first disc 174 align with the first ports 374 of the second disc 172. This allows drilling fluid within the second pressure chamber 127 to escape to the first input channels 184 and either flow out first exit orifices 384 or flow out exhaust channel 190 to exhaust orifices 192.

In a second stroke of the piston element 130, as the first and second discs 174 and 172 rotate further relative to one another, the through ports 370 of the first disc 174 align with the first ports 374 of the second disc 172. This allows drilling fluid to flow into the first input channels 184. From here the fluid can flow into the second pressure chamber 127 or flow down the first input channels 184 and out the first exit orifice 384. (See FIGS. 3*g* and 3*h*) Also during the second stroke the exhaust ports 372 of the first disc 174 align with the second ports 376 of the second disc 172. This allows drilling fluid within the first pressure chamber 126 to escape to the second input channels 186 and either flow out second exit orifices 386 or flow out exhaust channel 190 to exhaust orifices 192.

The drilling fluid may be drilling mud traveling down the drill string or hydraulic fluid isolated from the downhole drilling mud and circulated by a downhole motor. In various embodiments, the ports may be alternately opened electronically.

In the embodiment shown in FIG. 2, the first exit orifices 384 further comprise first exit nozzles 204, the second exit orifices 386 further comprise second exit nozzles 206, and the exhaust orifices 192 further comprise exhaust nozzles 209. (See FIG. 4)

The first exit nozzles 204, second exit nozzles 206, and exhaust nozzles 209 may be located on a drill bit 140. The drill bit 140 may have a plurality of cutting elements 142. The cutting elements 142 may comprise a superhard material such as diamond, polycrystalline diamond, or cubic boron nitride. The drill bit 140 may rotate around a jack element 138 which protrudes from the drill bit 140. The jack element 138 may be in contact with an impact element 136. In operation, as the piston element 130 slides within the inner cylinder 120 it may impact the impact element 136 which may force the jack element 138 to protrude farther from the drill bit 140 with repeated thrusts. It is believed that these repeated thrusts may aid the drill bit 140 in drilling through earthen formations. The jack element 138 may also comprise an angled end that may help steer the drill bit 140 through earthen formations.

One of the advantages of this embodiment is that if the first exit nozzles 204 and second exit nozzles 206 are similar in discharge area then it is believed that the pressure in the first pressure chamber 126 may be greater than the pressure in the second pressure chamber 127 during the first stroke and the reverse may be true during the second stoke. This is believed to be true because the discharge area of the exhaust nozzles 209 will always be added to the discharge area of the exit nozzles from which the drilling fluid is escaping. Another believed advantage of this embodiment is that the pressure differential between the first pressure chamber 126 and the second pressure chamber 127 may be able to be adjusted by adjusting the discharge area of the exhaust nozzle 209.

Referring now to FIGS. 3*a-j*, which are perspective diagrams of several components of the embodiment shown in FIG. 2.

Figure 3A:
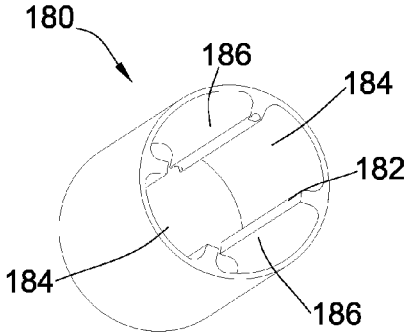
FIGS. 3*a-j* are perspective diagrams of several components of an embodiment of a downhole percussive tool.

FIG. 3*a* is a perspective diagram of an embodiment of the outer cylinder 180. As described earlier, outer cylinder 180 may have multiple internal flutes 182. The internal flutes 182 may be in contact with the internal cylinder 120 (see FIG. 3*b*) thus forming multiple input channels 184 and 186. The first input channels 184 may be aligned with second openings 324 (see FIG. 3*b*) to the second pressure chamber 127 thus allowing drilling fluid to flow into and out of the second pressure chamber 127. The second input channels 186 may be aligned with first openings 326 (see FIG. 3*b*) to the first pressure chamber 126 thus allowing drilling fluid to flow into and out of the first pressure chamber 126.

Figure 3B:
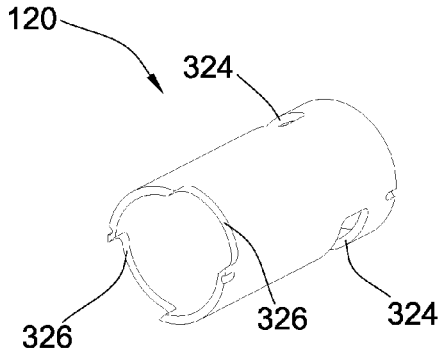

FIG. 3*b* is a perspective diagram of an embodiment of the inner cylinder 120. The inner cylinder 120 may comprise first openings 326 and second openings 324.

Figure 3C:
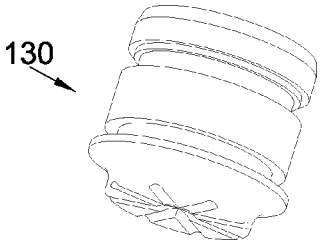

FIG. 3*c* is a perspective diagram of an embodiment of the piston element 130. The piston element 130 sits within the inner cylinder 120 (see FIG. 3*b*) and separates the inner cylinder into the first pressure chamber 126 and second pressure chamber 127. (See FIG. 2) In operation, the piston element 130 may impact the impact element 136. (See FIG. 3*d*).

Figure 3D:
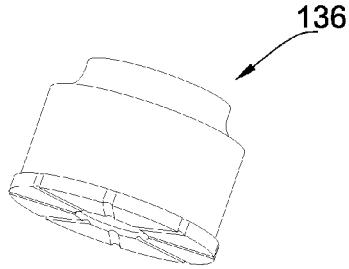

FIG. 3*d* is a perspective diagram of an embodiment of the impact element 136. It is believed that the force of the piston element 130 (see FIG. 3*c*) impacting the impact element 136 may apply repetitive force to the jack element 138 (see FIG. 3*i*) thus aiding in the breaking up of earthen formations.

Figure 3E:
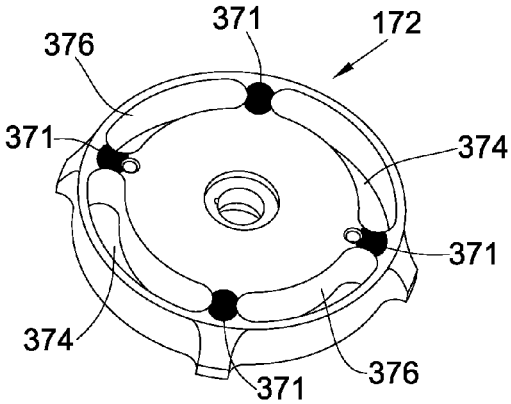

FIG. 3*e* is a perspective diagram of an embodiment of a second disc 172 which may form part of rotary valve 170. (See FIG. 2) Second disc 172 may comprise first ports 374 and second ports 376.

Figure 3F:
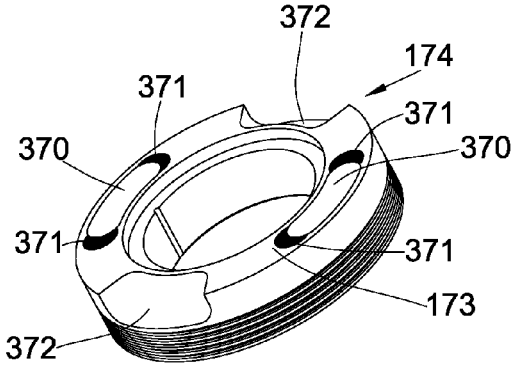

FIG. 3*f* is a perspective diagram of an embodiment of a first disc 174 which may form another part of rotary valve 170. (See FIG. 2) First disc 174 may comprise through ports 370 and exhaust ports 372. The first disc 174 may face the second disc 172 (see FIG. 3*e*) along a surface 173.

Figure 3G:
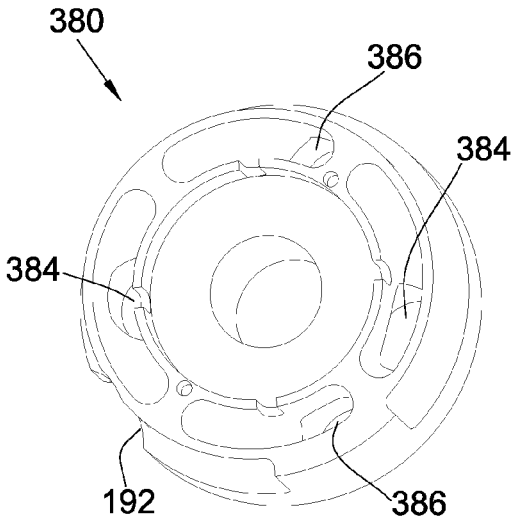
Figure 3H:
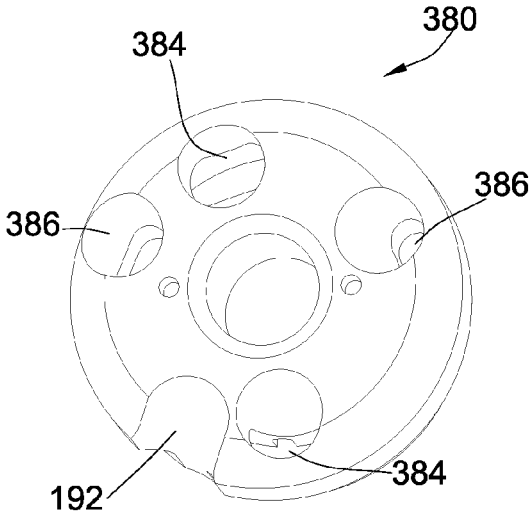

FIGS. 3*g* and 3*h* are perspective diagrams showing reverse sides of an embodiment of a flow plate 380. The flow plate 380 may comprise first exit orifices 384 and second exit orifices 386 which may conduct some of the flow from first input channels 184 and second input channels 186 respectively (see FIG. 2). Flow plate 380 may also comprise exhaust orifice 192 which may conduct some of the flow from exhaust channel 190 (see FIG. 2).

Figure 3I:
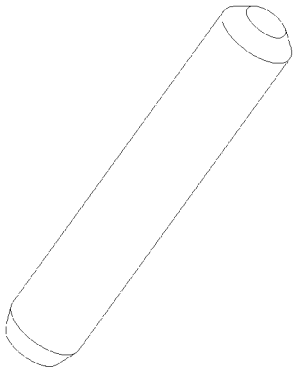

FIG. 3*i* is a perspective diagram of an embodiment of jack element 138. The jack element 138 may comprise steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

Figure 3J:
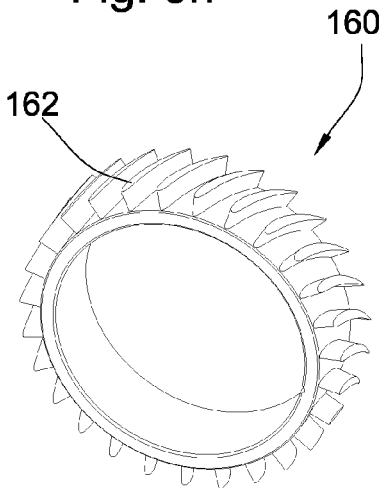

FIG. 3*j* is a perspective diagram of an embodiment of turbine 160. Turbine 160 may comprise a substantially circular geometry. Turbine 160 may also comprise multiple turbine blades 162. Turbine 160 may be adapted to rotate when drilling fluid flows past turbine blades 162.

Figure 4:
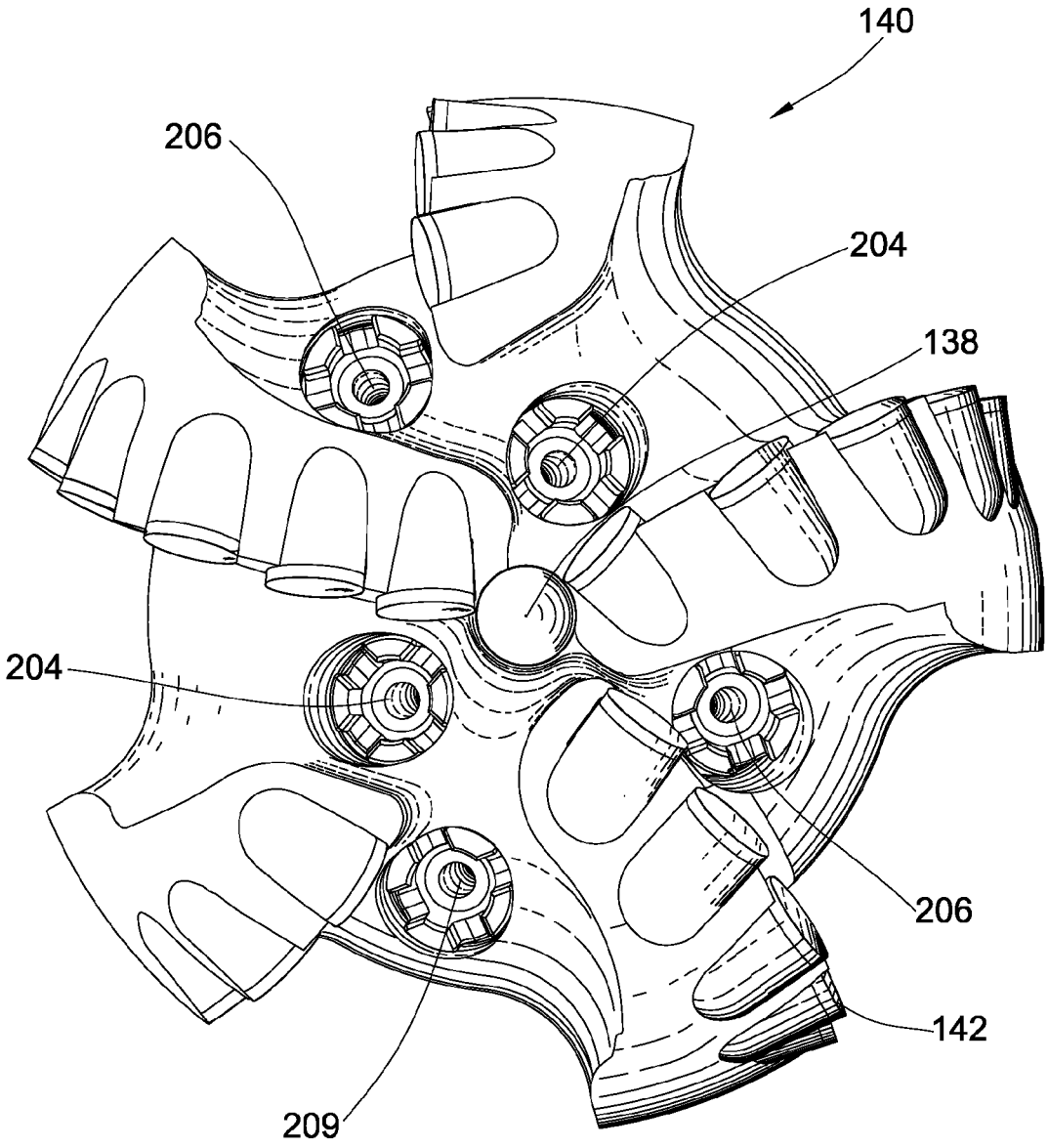
FIG. 4 is an axial diagram of an embodiment of a drill bit.

FIG. 4 is an axial diagram of an embodiment of a drill bit 140. Drill bit 140 may comprise first exit nozzles 204, second exit nozzles 206, and exhaust nozzles 209. Drill bit 140 may also comprise a plurality of cutting elements 142. Drill bit 140 may rotate around a jack element 138 which protrudes from the drill bit 140.

Figure 5:
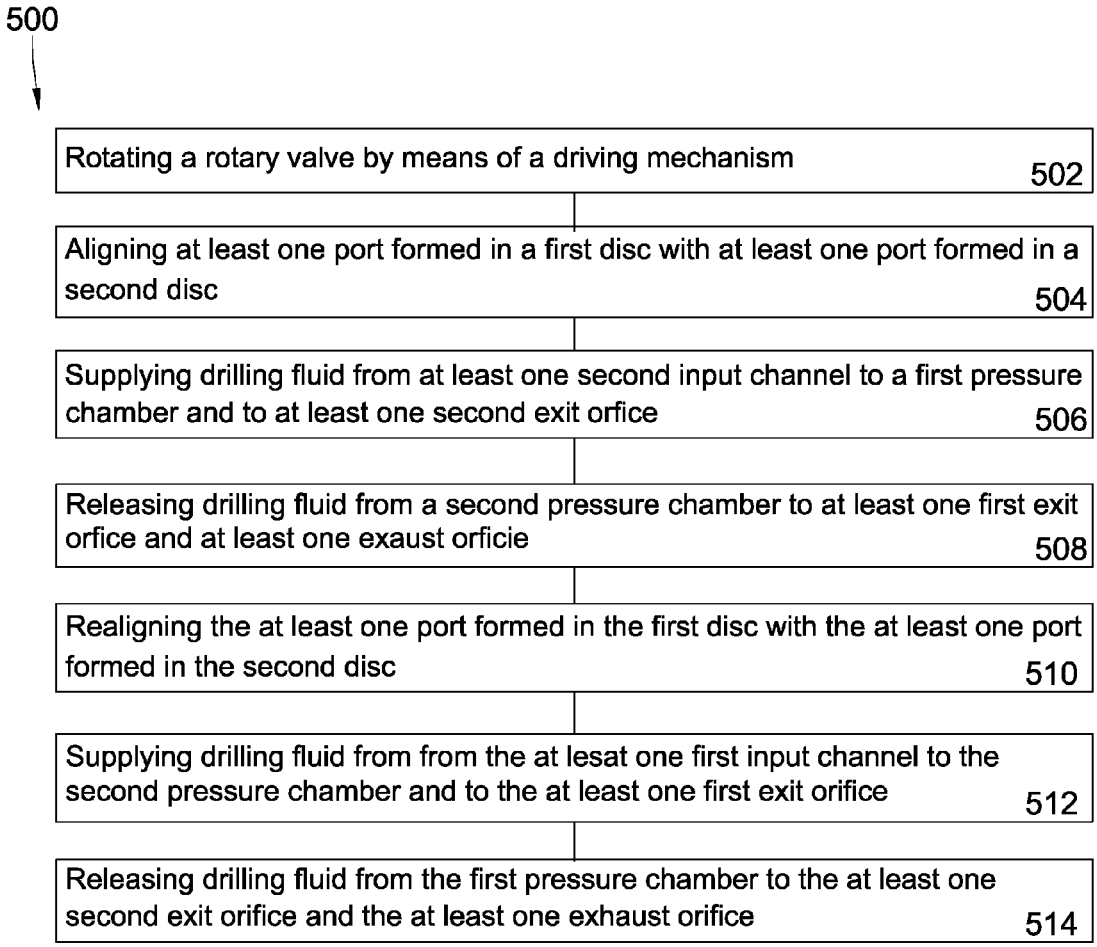
FIG. 5 is a flow diagram of an embodiment of a method of actuating a downhole drill string tool.

FIG. 5 is a flow diagram of an embodiment of a method of actuating a downhole drill string tool 500. Method 500 comprises the steps of rotating a rotary valve by means of a driving mechanism 502; aligning at least one port formed in a first disc with at least one port formed in a second disc 504; supplying drilling fluid from at least one second input channel to a first pressure chamber and to at least one second exit orifice 506; releasing drilling fluid from a second pressure chamber to at least one first exit orifice and at least one exhaust orifice 508; realigning the at least one port formed in the first disc with the at least one port formed in the second disc 510; supplying drilling fluid from the at least one first input channel to the second pressure chamber and to the at least one first exit orifice 512; and releasing drilling fluid from the first pressure chamber to the at least one second exit orifice and the at least one exhaust orifice 514. The rotating a rotary valve by means of a driving mechanism 502 may comprise passing drilling fluid past a turbine comprising multiple turbine blades which then rotates a rotary valve. The rotating 502 may also comprise rotating a motor or other driving means known in the art.

Figure 6A:
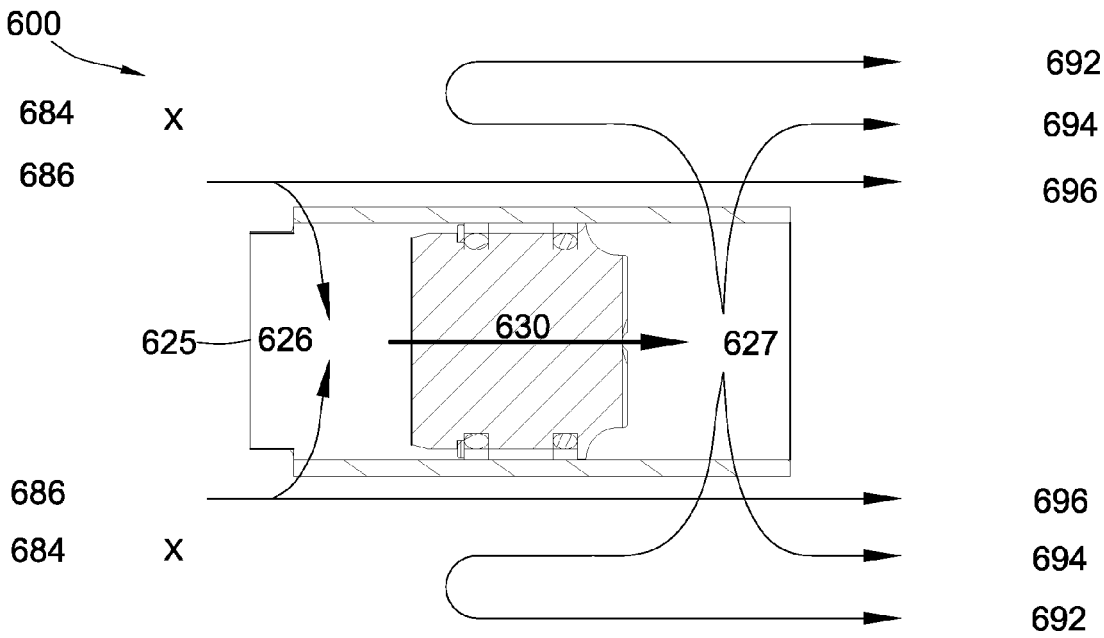
FIG. 6*a* is a representative drilling fluid flow diagram of an embodiment of a first stroke of a downhole drill string tool.
Figure 6B:
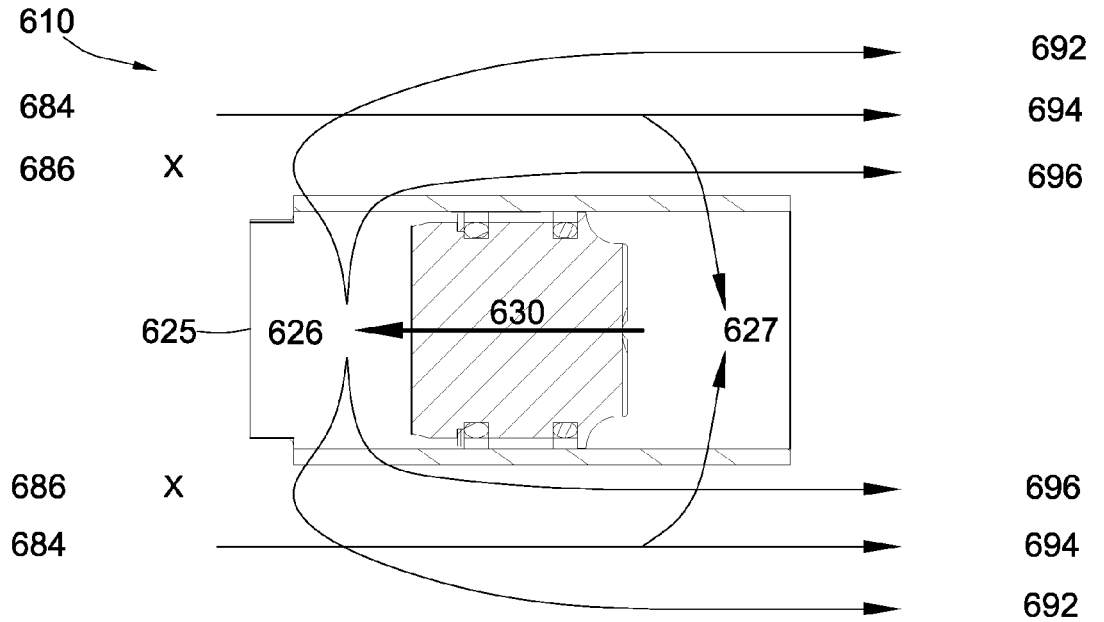
FIG. 6*b* is a representative drilling fluid flow diagram of an embodiment of a second stroke of a downhole drill string tool.

FIGS. 6*a* and 6*b* are drilling fluid flow diagrams representing embodiments of first and second strokes 600 and 610 respectively of a downhole drill string tool. FIG. 6*a* represents a piston element 630 sitting within an interior chamber 625 and dividing it into a first pressure chamber 626 and a second pressure chamber 627. During first stroke 600, first input channels 684 are sealed and second input channels 686 are open thus allowing drilling fluid to flow into first pressure chamber 626 or out a second exit orifice 696. Meanwhile, drilling fluid within second pressure chamber 627 is allowed to escape out of first exit orifice 694 and exhaust orifice 692. It is believed that if the discharge areas of first exit orifice 694 and second exit orifice 696 are similar then the additional discharge area of the exhaust orifice 692 will cause the pressure in the first pressure chamber 626 to be greater than the pressure in the second pressure chamber 627 during the first stroke 600 and thus cause the piston element 630 to move away from the first pressure chamber 626 and toward the second pressure chamber 627. It is additionally believed that the pressure differential between the first pressure chamber 626 and the second pressure chamber 627 will be able to be adjusted by adjusting the size of the exhaust orifice 692.

During second stroke 610, second input channels 686 are sealed and first input channels 684 are open thus allowing drilling fluid to flow into second pressure chamber 627 or out a second exit orifice 696. Meanwhile, drilling fluid within first pressure chamber 626 is allowed to escape out of second exit orifice 696 and exhaust orifice 692. It is believed that this will cause the pressure in the second pressure chamber 627 to be greater than the pressure in the first pressure chamber 626 and thus cause the piston element 630 to move away from the second pressure chamber 627 and toward the first pressure chamber 626.

Figure 7:
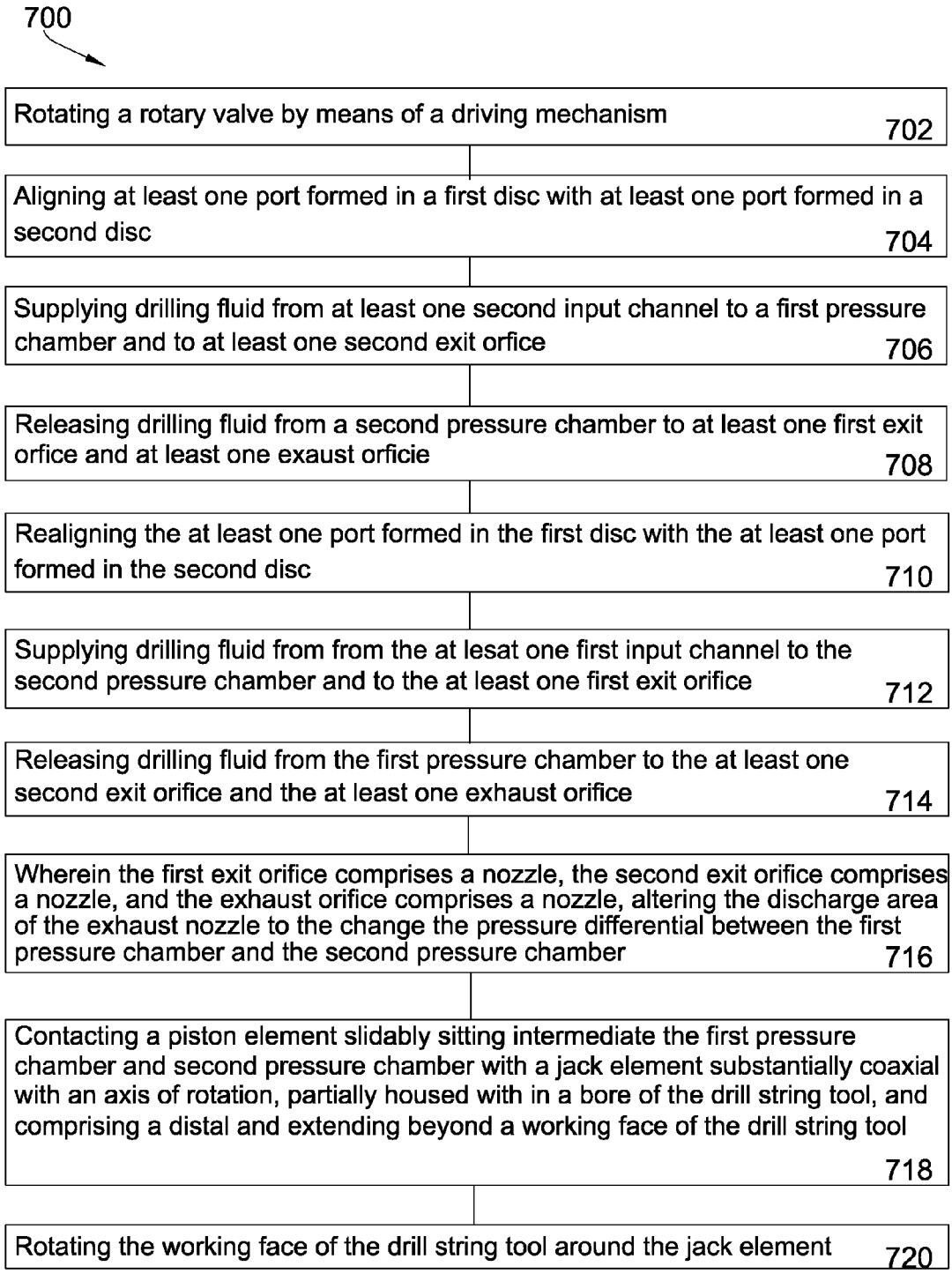
FIG. 7 is a flow diagram of an embodiment of a method of actuating a downhole drill string tool comprising a jack element.

FIG. 7 is a flow diagram of an embodiment of a method of actuating a downhole drill string tool comprising a jack element 700. Method 700 comprises the steps of rotating a rotary valve by means of a driving mechanism 702; aligning at least one port formed in a first disc with at least one port formed in a second disc 704; supplying drilling fluid from at least one second input channel to a first pressure chamber and to at least one second exit orifice 706; releasing drilling fluid from a second pressure chamber to at least one first exit orifice and at least one exhaust orifice 708; realigning the at least one port formed in the first disc with the at least one port formed in the second disc 710; supplying drilling fluid from the at least one first input channel to the second pressure chamber and to the at least one first exit orifice 712; releasing drilling fluid from the first pressure chamber to the at least one second exit orifice and the at least one exhaust orifice 714; wherein the first exit orifice comprises a nozzle, the second exit orifice comprises a nozzle, and the exhaust orifice comprises a nozzle, altering the discharge area of the exhaust nozzle to change the pressure differential between the first pressure chamber and the second pressure chamber 716; contacting a piston element slidably sitting intermediate the first pressure chamber and second pressure chamber with a jack element substantially coaxial with an axis of rotation, partially housed within a bore of the drill string tool, and comprising a distal end extending beyond a working face of the drill string tool 718; and rotating the working face of the drill string tool around the jack element 720. It is believed that the percussive action of the jack element will help break up earthen formations that may be surrounding the downhole drill string tool and thus allow it to progress more rapidly through the earthen formations.

Figure 8:
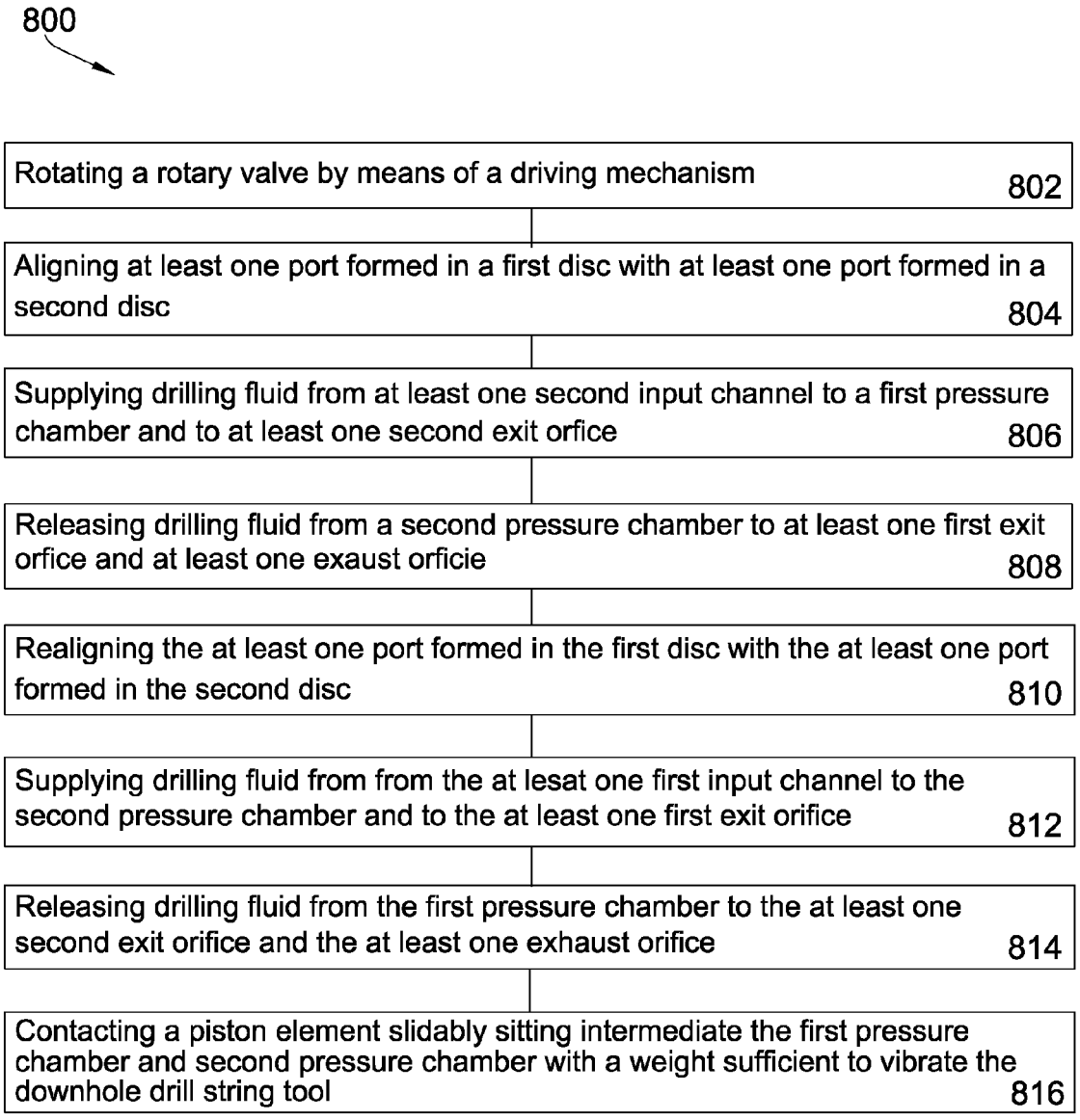
FIG. 8 is a flow diagram of an embodiment of a method of actuating a downhole drill string tool comprising vibrating means.

FIG. 8 is a flow diagram of an embodiment of a method of actuating a downhole drill string tool comprising vibrating means 800. Method 800 comprises the steps of rotating a rotary valve by means of a driving mechanism 802; aligning at least one port formed in a first disc with at least one port formed in a second disc 804; supplying drilling fluid from at least one second input channel to a first pressure chamber and to at least one second exit orifice 806; releasing drilling fluid from a second pressure chamber to at least one first exit orifice and at least one exhaust orifice 808; realigning the at least one port formed in the first disc with the at least one port formed in the second disc 810; supplying drilling fluid from the at least one first input channel to the second pressure chamber and to the at least one first exit orifice 812; releasing drilling fluid from the first pressure chamber to the at least one second exit orifice and the at least one exhaust orifice 814; and contacting a piston element slidably sitting intermediate the first pressure chamber and second pressure chamber with a weight sufficient to vibrate the downhole drill string tool 816. It is believed that the percussive action of the weight will help downhole drill string tool break free when caught on earthen formations that may be surrounding the downhole drill string tool and otherwise allow it to progress more rapidly through the earthen formations.

Whereas the present invention has been described in particular relation to the drawings attached hereto, it should be understood that other and further modifications apart from those shown or suggested herein, may be made within the scope and spirit of the present invention.

What is claimed is:

1. A downhole drill string tool, comprising:

an interior chamber;

a piston element that slidably sits within the interior chamber;

a jack element comprising a proximal end within the interior chamber and a distal end extending beyond a working face of the downhole drill string tool; and at least two ports to the interior chamber that selectively direct a fluid to slideably move the piston element;

wherein as the piston element slides within the interior chamber the piston element impacts the proximal end of the jack element;

wherein the ports are adapted to align with other ports formed in a rotary valve connected to a turbine disposed within a fluid bore of the downhole drill string tool.

2. The tool of claim 1, wherein the jack element comprises a hard distal end comprising natural diamond, polycrystalline diamond, vapor deposited diamond, cubic boron nitride, diamond impregnated carbide, diamond impregnated matrix, silicon bounded diamond, or a combination thereof.

3. The tool of claim 1, wherein the ports are opened electronically.

4. The tool of claim 1, wherein the fluid is drilling mud.

5. The tool of claim 1, wherein the fluid is a hydraulic fluid isolated from downhole drilling mud.

6. The tool of claim 1, wherein a downhole motor circulates the fluid to cause the piston element to impact the jack element.

7. The tool of claim 1, wherein the proximal end of the jack element is enhanced with a superhard material capable of withstanding the impacts.

8. The tool of claim 7, wherein the superhard material comprises diamond, cubic boron nitride, or silicon carbide.

9. The tool of claim 1, wherein the jack element has a surface formed to receive the piston element.

10. The tool of claim 1, wherein the tool further comprises drilling fluid disposed within the interior chamber and at a pressure differential sufficient to slide the piston element.

11. The tool of claim 1, wherein the piston element is adapted to retract from the proximal end of the jack element.

12. The tool of claim 1, wherein the piston element has a weight sufficient to force the jack element to break earth formations upon impact.

13. The tool of claim 1, wherein the jack element is rotationally isolated from the downhole drill string tool.

14. The tool of claim 1, wherein the distal end of the jack element is angled to deviate the drill string tool off of a straight course.

15. The tool of claim 1, wherein a sealing assembly is disposed intermediate an outer surface of the piston element and in inner surface of the interior chamber.

16. A method of actuating a drill string hammer, comprising:

providing a drill bit with a jack element comprising a distal end protruding beyond a working face of the drill bit and a proximal end disposed within an interior chamber of the drill bit;

further providing a piston element disposed within the interior chamber, the piston element being adapted to slideably move within the interior chamber, wherein the piston is moved by fluid ported by a turbine driven rotary value;

sliding the piston element within the interior chamber by pressurizing the interior chamber with a fluid; and imparting an impact load into a formation proximate the distal end by impacting the proximal end of a jack element with the piston element.

17. The method of claim 16, wherein the method further comprises retracting the piston element from the proximal end of the jack element.

18. The method of claim 16, wherein the step of impacting has more force than the retracting.

19. The method of claim 16, wherein the fluid is exhausted from the interior chamber into a bore of the drill bit.

* * * * *